US009693610B2

(12) United States Patent
Kim

(10) Patent No.: US 9,693,610 B2
(45) Date of Patent: Jul. 4, 2017

(54) DEVICE FOR FASTENING AND UNFASTENING WATCH

(71) Applicant: KONO CORPORATION LTD, Seoul (KR)

(72) Inventor: Geun Ho Kim, Seoul (KR)

(73) Assignee: KONO CORPORATION LTD, Seoul (KR)

( * ) Notice: Subject to any disclaimer, the term of this patent is extended or adjusted under 35 U.S.C. 154(b) by 0 days.

(21) Appl. No.: 15/200,812

(22) Filed: Jul. 1, 2016

(65) Prior Publication Data

US 2017/0000223 A1 Jan. 5, 2017

(30) Foreign Application Priority Data

Jul. 3, 2015 (KR) ..... 10-2015-0095107

(51) Int. Cl.

| | |
|---|---|
| ***G04B 37/00*** | (2006.01) |
| ***A44C 5/24*** | (2006.01) |
| ***A44C 5/14*** | (2006.01) |
| ***A44C 5/16*** | (2006.01) |
| *G04B 37/14* | (2006.01) |

(52) U.S. Cl.

CPC ..... *A44C 5/24* (2013.01); *A44C 5/147* (2013.01); *A44C 5/16* (2013.01); *G04B 37/00* (2013.01); *G04B 37/1486* (2013.01)

(58) Field of Classification Search

CPC .... G04B 37/00; G04B 37/1486; A44C 5/147; A44C 5/16; A44C 5/24

See application file for complete search history.

(56) References Cited

U.S. PATENT DOCUMENTS

| | | | | |
|---|---|---|---|---|
| 2,169,738 A * | 8/1939 | Moody | ..... | A44C 5/24 368/281 |
| 4,748,604 A * | 5/1988 | Lambert | ..... | A44C 5/24 224/174 |
| 5,274,613 A * | 12/1993 | Seager | ..... | H04B 1/385 368/13 |
| 7,591,581 B2 * | 9/2009 | Lovegrove | ..... | A44C 5/24 368/276 |

(Continued)

FOREIGN PATENT DOCUMENTS

| | | |
|---|---|---|
| KR | 2019990017625 | 5/1999 |
| KR | 2001775330000 | 1/2000 |

(Continued)

*Primary Examiner* — Vit W Miska

(74) *Attorney, Agent, or Firm* — IPLA P.A.; James E. Bame

(57) ABSTRACT

Provided is a device for fastening and unfastening a watch, in which a plurality of bezels is provided and a fastening means is provided between the bezels, so that the watch is easily and conveniently fastened and unfastened in a one-touch manner, thus completely preventing the bezels from being damaged, and providing a novel structure for fastening and unfastening a wrist watch, unlike a general watch that has a fastening and unfastening structure on a watch band. Therefore, it is possible to solve problems of inconvenience when fastening and unfastening a watch band on a user's wrist because the fastening structure applied to the band in the conventional wrist watch is eliminated, in addition to offering good appearance and allowing the watch to be easily detachably attached.

3 Claims, 14 Drawing Sheets

(56) References Cited

U.S. PATENT DOCUMENTS

| | | | | |
|---|---|---|---|---|
| 7,988,349 | B2 * | 8/2011 | Anderson | G04B 37/0427<br>368/278 |
| 2012/0087215 | A1 * | 4/2012 | Fantoni | G04B 37/14<br>368/281 |

FOREIGN PATENT DOCUMENTS

| | | |
|---|---|---|
| KR | 2001861810000 | 4/2000 |
| KR | 1020010053495 | 6/2001 |

* cited by examiner

DEVICE FOR FASTENING AND UNFASTENING WATCH

CROSS REFERENCE

The present application claims priority to Korean Patent Application No. 10-2015-0095107, filed Jul. 3, 2015, the entire contents of which is incorporated herein for all purposes by this reference.

BACKGROUND

The present invention relates generally to a device for fastening and unfastening a wrist watch. More particularly, the present invention relates to a device for fastening and unfastening a watch, in which a plurality of bezels is provided and a fastening means is provided between the bezels, so that the watch is easily and conveniently fastened and unfastened in a one-touch manner, thus completely preventing the bezels from being damaged, and providing a novel structure for fastening and unfastening a wrist watch, unlike a general watch that has a fastening and unfastening structure on a watch band. Therefore, it is possible to solve problems of inconvenience when fastening and unfastening a watch band on a user's wrist because the fastening structure applied to the band in the conventional wrist watch is eliminated, in addition to offering good appearance and allowing the watch to be easily detachably attached.

Generally, a wrist watch includes a watch main body having a component for driving the watch and a time display, a bezel unit provided around the watch main body to constitute a cover of the watch, and a band fastening the watch to a wearer's wrist.

In most of conventional watches, the bezel has a great influence on an appearance of the watch. Thus, people generally attempt to design the bezel to be beautiful.

That is, since the bezel is integrally formed on the watch main body itself, a material of the bezel is limited to metal that is a material of the watch main body. In order to overcome such a limit, a method of coloring the material is usually employed. As such, conventionally, the bezel has been developed to have various shapes or colors for the purpose of providing good appearance.

Meanwhile, in the case of a wrist watch, various configurations of watch bands are used to fasten the watch to a user's wrist. The various types of bands include a strap made of a metallic material, or a strip-type strap made of a synthetic resin or leather material.

The metallic watch strap is configured such that both ends thereof are connected to both sides of a watch body, respectively, and a locking device is installed at a central portion of the strap That is, after the watch strap is fitted over the wrist, the watch strap may be fixed to surround the wrist via a fastening device.

The strip-type watch strap is composed of two strips, namely, first and second strips. In the state where one ends of the respective strips are connected to both ends of the watch body, the other ends thereof are fixed by a holder.

That is, such a watch includes the first and second strips connected to the watch body, respectively. A plurality of holes is continuously formed in a surface of the first strip in a longitudinal direction thereof, and a buckle is provided on an end of the second strip that has a guide hole through which the end of the first strip passes, and a buckle tongue is provided in the buckle and is selectively fitted into an associated hole of the first strip to serve as a holder.

In other words, the strip-type watch strap is used as follows: in the state where the watch body is placed on the wrist, the end of the first strip passes through the guide hole formed in the buckle on the second strip and then the buckle tongue formed in the buckle is located in the hole of the first strip. Thereby, the locking of the watch strap is performed.

Thereafter, an exposed end of the first strip passes through at least two guide rings formed on the second strip to be located at a desired position, so that the securing of the watch strap is completed.

However, since the first strip should be fitted into the guide ring again in the state where the first and second strips are held by the buckle tongue, it is difficult to put on or take off the watch.

That is, the metallic watch strap and the strip-type watch strap made of the synthetic resin or leather material are problematic in that they should be fastened to the wrist by a certain fastening means, thus the fastening causes an inconvenience to a user, causing the user's wrist to be irritated and injured or leading to poor blood circulation or other health problems because the fastening means presses the wrist. Moreover, the fastening means is exposed to the outside, thus reducing the appearance of the watch.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and an object of the present invention is intended to propose a device for fastening and unfastening a watch, in which a fastening means is provided on a watch bezel rather than a watch band.

Another object of the present invention is intended to propose a device for fastening and unfastening a watch, in which a fastening means is not provided on a watch band, thus offering good appearance.

A further object of the present invention is intended to propose a device for fastening and unfastening a watch, which completely prevents blood circulation from being obstructed and prevents a wearer's wrist from being injured unlike the related art in which the fastening means is provided on the watch band thereby causing the wearer's wrist to be injured or placing undesirable pressure on the wearer's wrist.

Still another object of the present invention is intended to propose a device for fastening and unfastening a watch, in which a watch band performs only a wrist banding function that is an original function of the watch band.

Yet another object of the present invention is intended to propose a device for fastening and unfastening a watch, in which a fastening means is provided on a bezel, thus allowing a watch to be smoothly fastened or unfastened easily and conveniently in a stable one-touch manner without damaging the bezel.

In order to accomplish the above objects, the present invention is intended to propose a device for fastening and unfastening a watch including a watch main body having a component for driving the watch and a time display, a bezel unit provided around the watch main body to constitute a cover of the watch, and a watch band fastening the watch to a wearer's wrist, the watch band being integrated with the watch and the bezel unit being provided with a fastening unit, wherein the fastening unit provided on the bezel unit includes a watch main body-covering bezel configured to cover the watch main body, and having a first protrusion on a center of a first side of the bezel and a second protrusion on a center of a second side of the bezel; a rotatable connecting bezel having on a lower end of a center of a first side thereof a first groove in a state where the rotatable connecting bezel is rotatably connected to both ends of the second side of the watch main body-covering bezel by a first hinge; a fastening bezel rotatably connected to both ends of the first side of the rotatable connecting bezel by a second hinge, with a second groove being formed on an inner surface of a center of a second side of the fastening bezel; and the watch band integrally coupled from an outer surface of the second side of the fastening bezel to an outer surface of the first side of the watch main body-covering bezel.

Further, the present invention is intended to propose a device for fastening and unfastening a watch, the device including a watch main body having a component for driving the watch and a time display, a plurality of extension pieces formed on a first side thereof and a third hinge formed on a second side thereof, wherein a first side of a watch band is coupled to the extension piece, with a through hole penetrated through a leading end of the extension piece, and a first fastening unit is fitted into the through hole; a rotatable connecting bezel rotatably coupled at a first side thereof with the watch main body by the third hinge, and having on a second side thereof a second fastening unit that collaterally serves as a fourth hinge, with a fastening projection being provided on an outer circumference of an upper portion of the third hinge; and a fastening bezel rotated at a first side thereof by the second fastening unit that collaterally serves as the fourth hinge of the rotatable connecting bezel, and coupled at a second side thereof with the second side of the watch band, with a fastening hole formed in an inner circumference of the fastening bezel, so that the watch band is integrally coupled from the extension piece of the watch main body to the second side of the fastening bezel.

The first fastening unit may be coupled to the through hole, and may include a button provided on a first side of the first fastening unit to protrude out from the through hole; a guide bar integrally provided on the button; a fastening bar fastened to an end of the guide bar in a screw-type fastening method; a spring coupled to the fastening bar; a spring removal prevention plate provided on an end of the spring; and a fastening hook integrally formed on an end of the fastening bar, and the second fastening unit collaterally serving as the fourth hinge may be provided on a side of the rotatable connecting bezel and the fastening bezel, and may have a groove of a predetermined length to allow the fastening hook to be movable, a locking step being provided on a leading end of the groove to fasten the fastening hook thereto.

As described above, the present invention provides a device for fastening and unfastening a watch, in which a fastening means is provided on a bezel rather than on a watch band, thus offering good appearance and completely preventing blood circulation from being obstructed and preventing the wrist from being injured unlike the related art in which the fastening means is provided on the watch band thereby causing the wrist to be injured or placing undesirable pressure on the wearer's wrist, and in which the fastening means is provided on the bezel to be smoothly fastened and unfastened easily and conveniently in a one-touch manner without damaging the bezel, thus performing a wrist banding function that is an original function of the watch band, preventing the watch from being broken or damaged due to an unintended releasing phenomenon occurring in the conventional fastening device, and in which stable fastening is maintained, thus lengthening a service life of the watch band, and realizing an aesthetic design having simplicity and unity that are important elements of a modern design, due to the omission of a band connecting part.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Hereinafter, the configuration and operation of a device for fastening and unfastening a watch according to the present invention will be described in detail with reference to the accompanying drawings.

Figure 1:
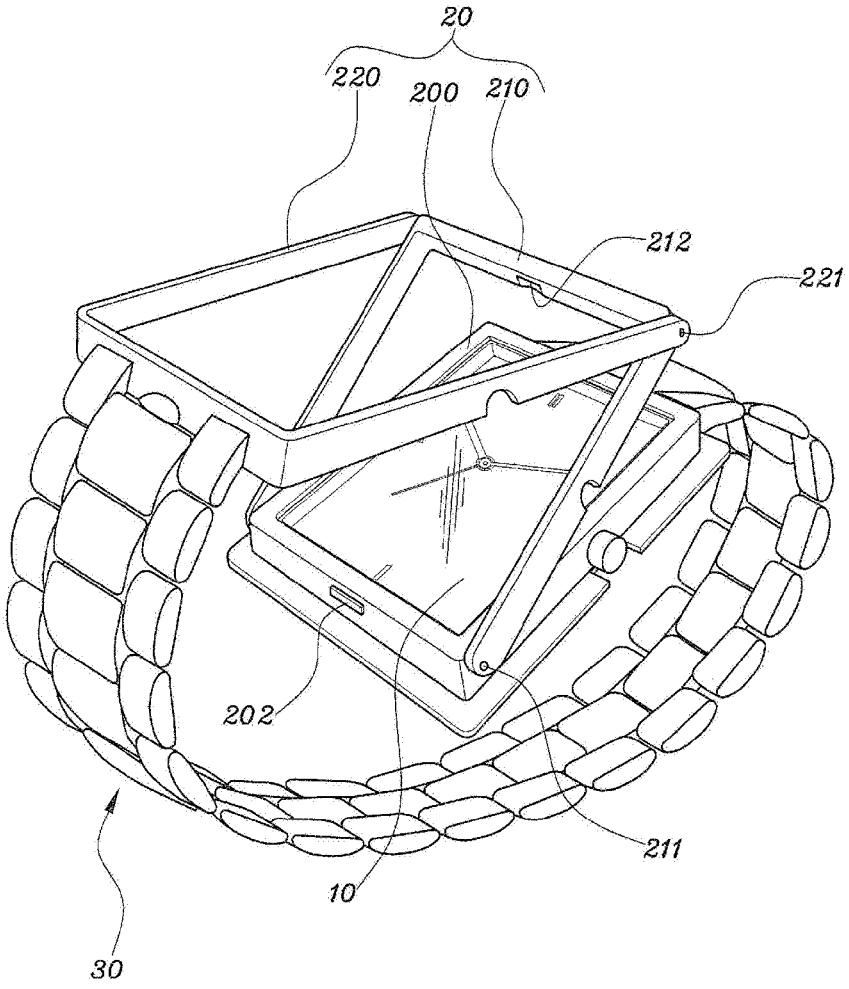
FIG. 1 is a perspective view illustrating a watch equipped with a device for fastening and unfastening a watch according to the present invention.
Figure 2:
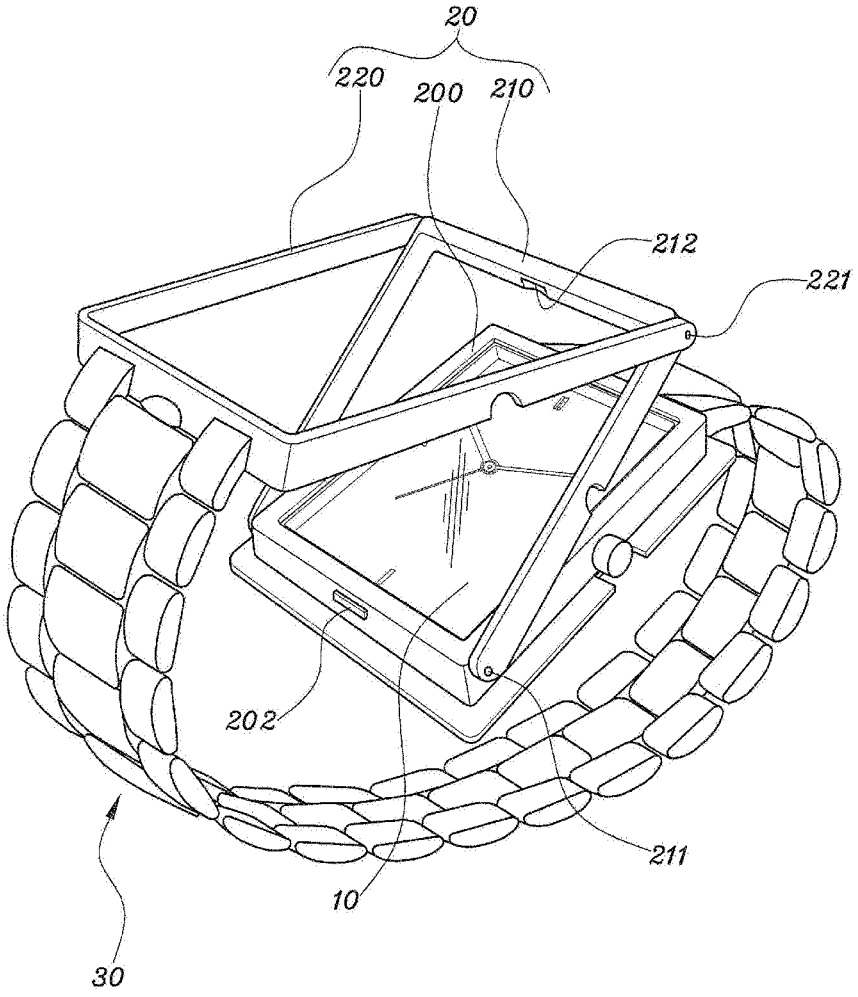
FIG. 2 is a perspective view illustrating a state in which the device for fastening and unfastening the watch according to the present invention is released.
Figure 3:
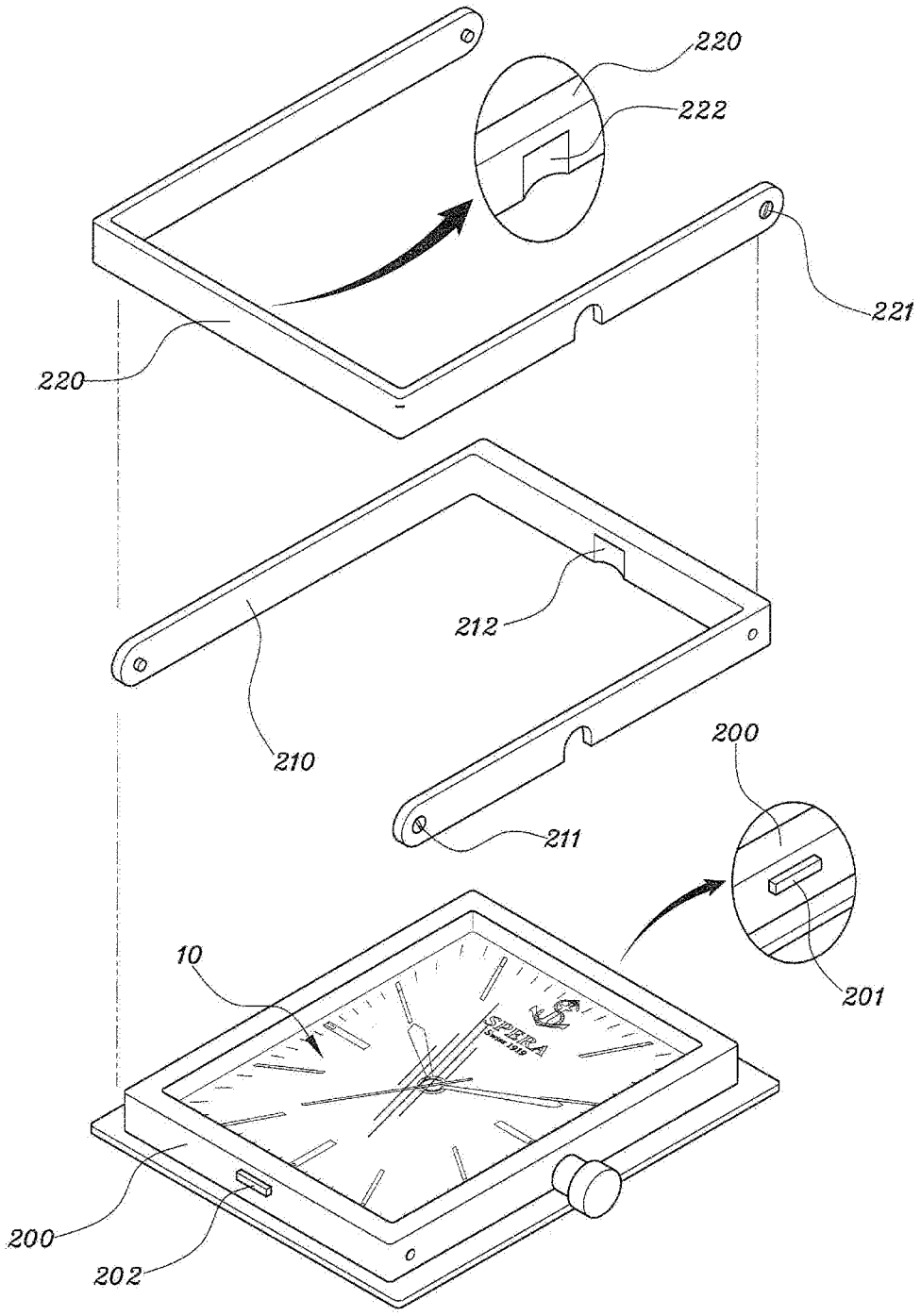
FIG. 3 is an exploded perspective view illustrating essential parts of the device for fastening and unfastening the watch according to the present invention.
Figure 4:
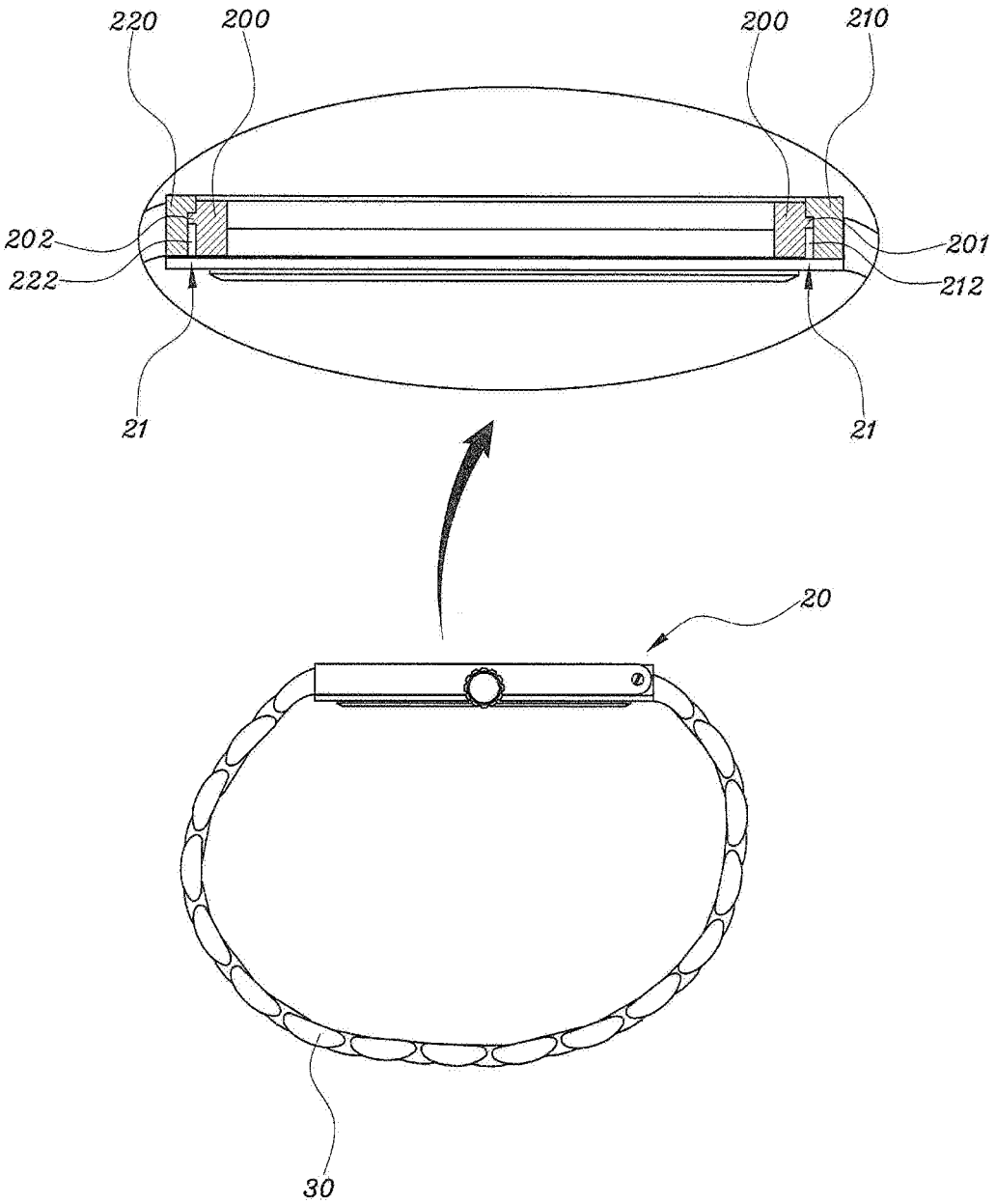
FIG. 4 is a sectional view illustrating a coupled state of the essential parts of the device for fastening and unfastening the watch according to the present invention.
Figure 5:
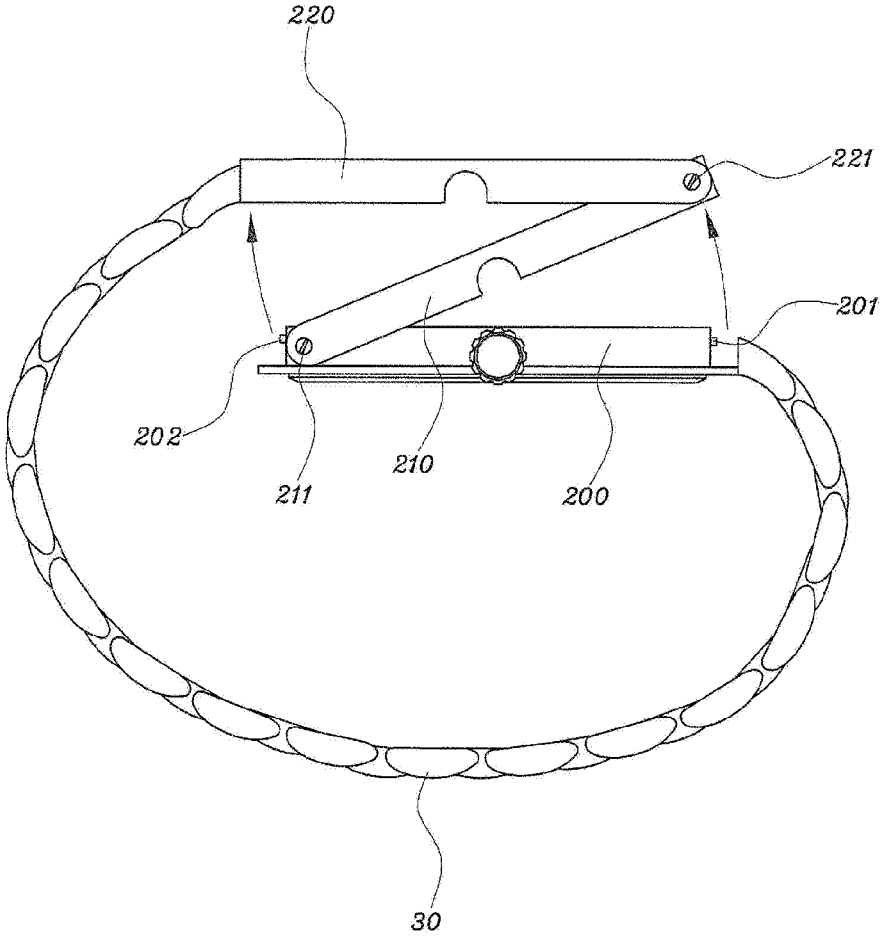
FIG. 5 is a front view illustrating a releasing process in the device for fastening and unfastening the watch according to the present invention.
Figure 6:
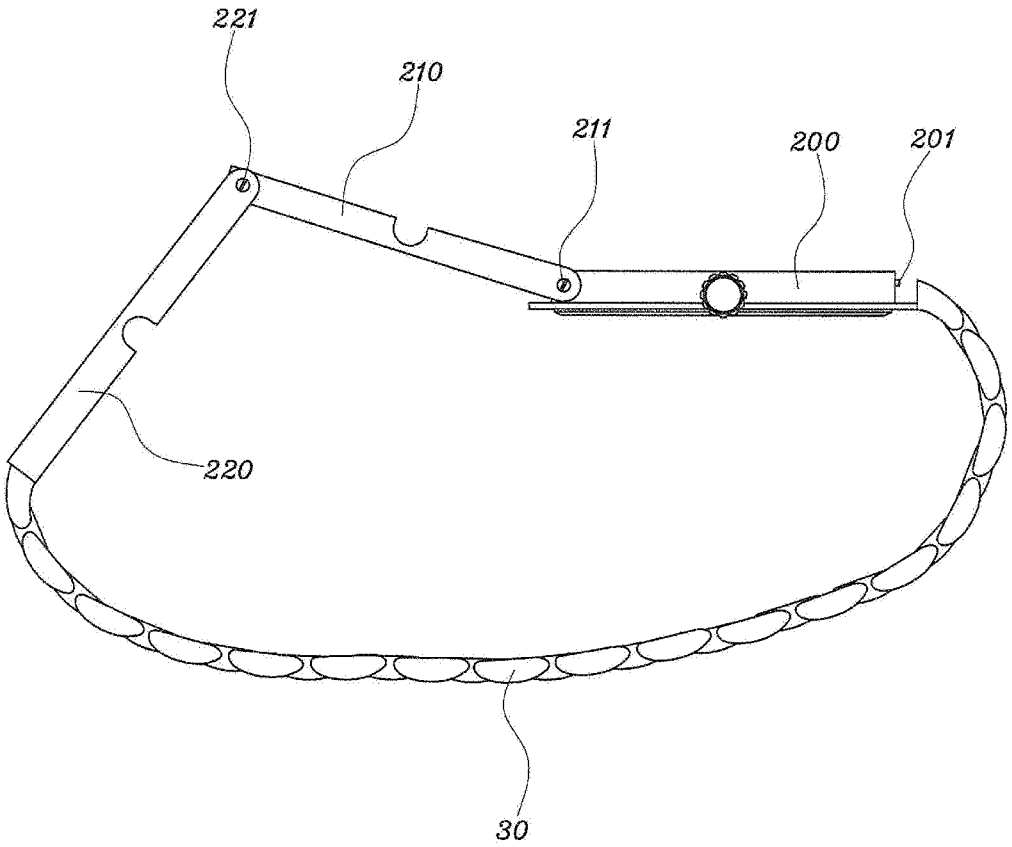
FIG. 6 is a front view illustrating a completely released state in the device for fastening and unfastening the watch according to the present invention.
Figure 7:
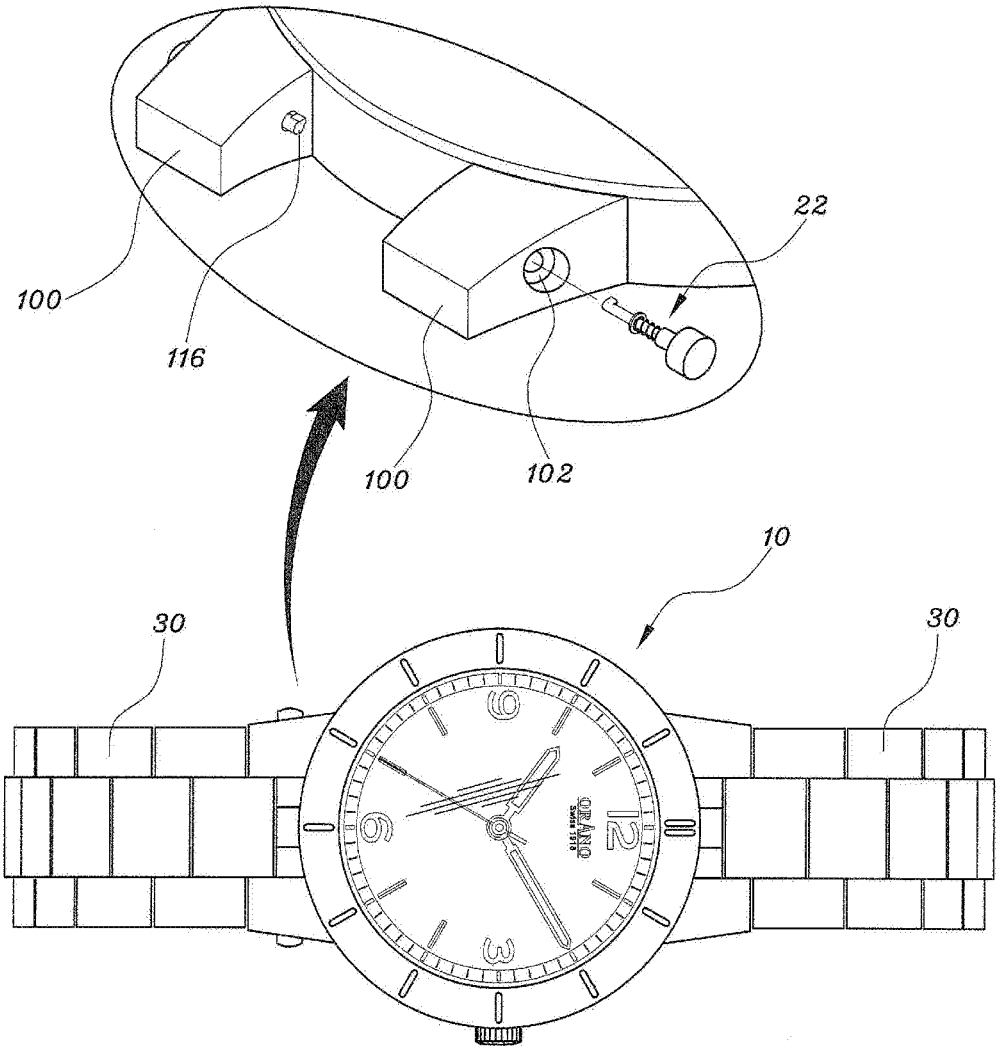
FIG. 7 illustrates a watch equipped with a device for fastening and unfastening a watch according to another embodiment of the present invention in a plan view and a perspective view.
Figure 8:
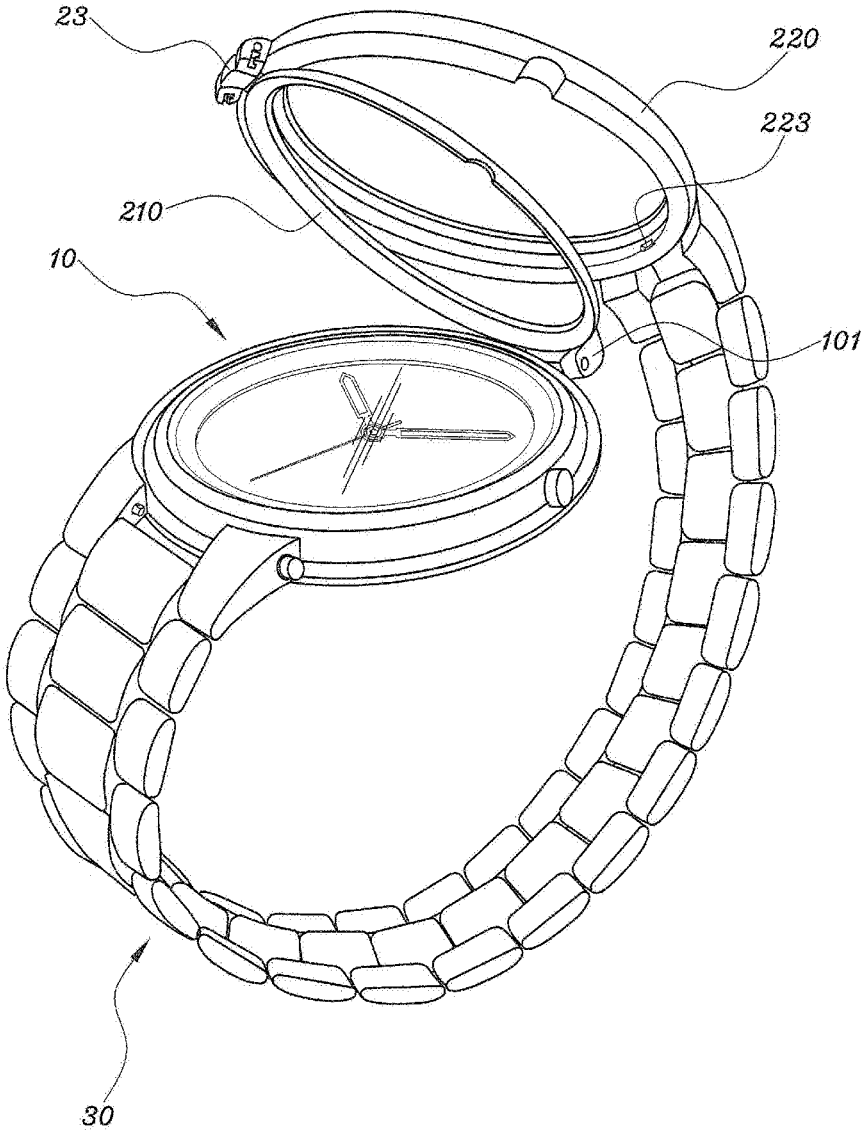
FIG. 8 is a perspective view illustrating a state in which a connecting bezel and a fastening bezel are released from a main body of the watch equipped with the device for fastening and unfastening the watch of FIG. 7 according to another embodiment of the present invention.
Figure 9:
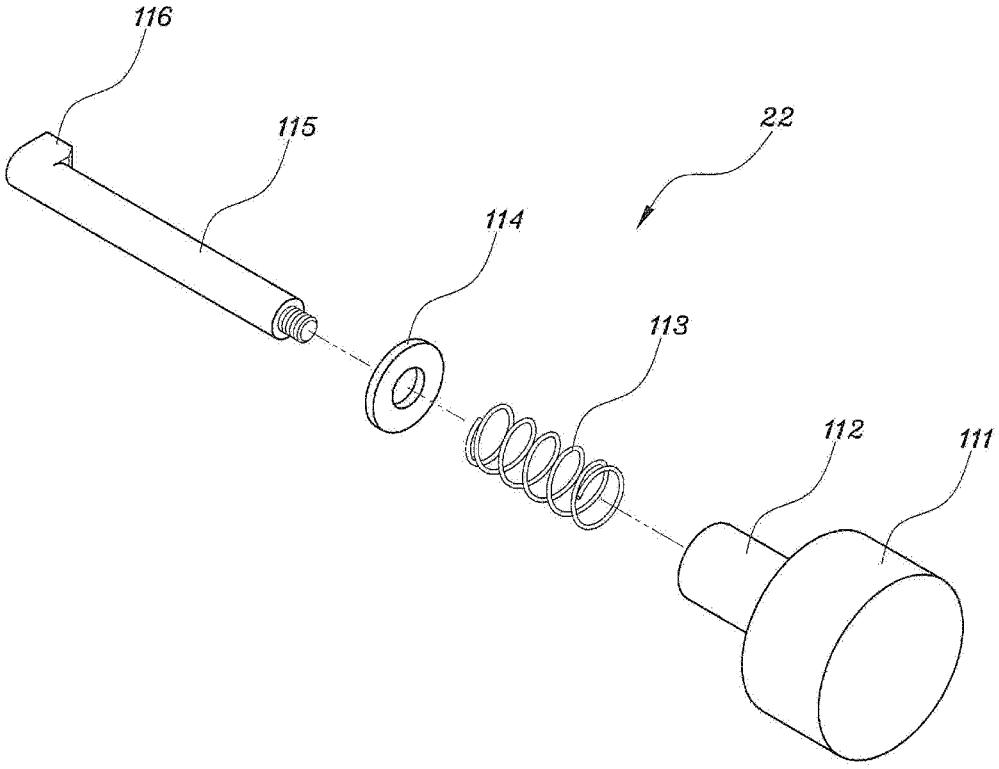
FIG. 9 is an exploded perspective view illustrating a first fastening unit of the device for fastening and unfastening the watch of FIG. 7 according to another embodiment of the present invention.
Figure 10:
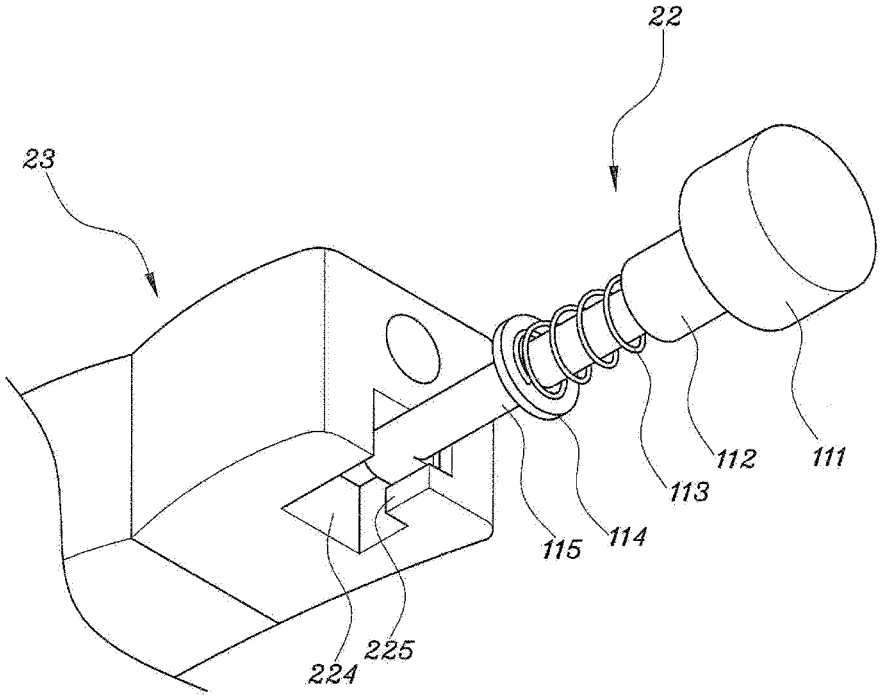
FIG. 10 is a perspective view illustrating a state in which the first fastening unit is fastened to a second fastening unit collaterally serving as a fourth hinge, in the device for fastening and unfastening the watch of FIG. 7 according to another embodiment of the present invention.
Figure 11:
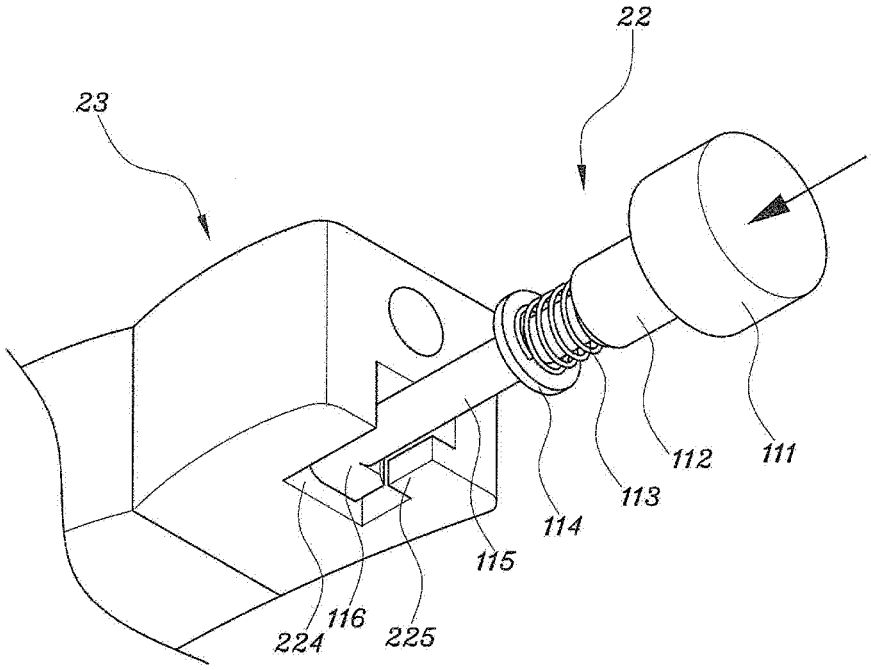
FIG. 11 is a perspective view illustrating a state in which the first fastening unit is released from the second fastening unit collaterally serving as the fourth hinge by pressing, in the device for fastening and unfastening the watch of FIG. 7 according to another embodiment of the present invention.
Figure 12:
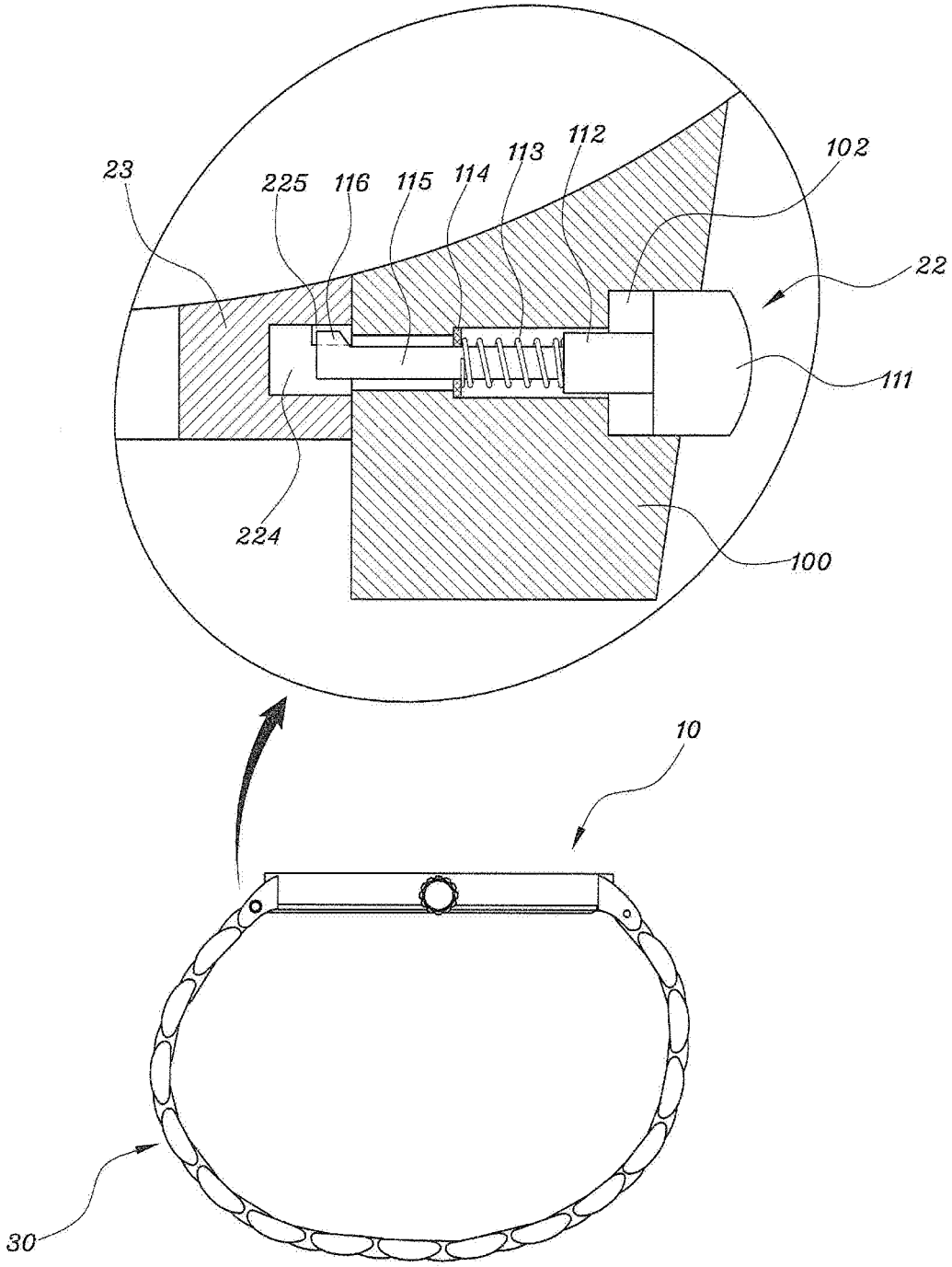
FIG. 12 is an enlarged sectional view illustrating the state in which the first fastening unit is fastened to a second fastening unit collaterally serving as the fourth hinge, in the device for fastening and unfastening the watch of FIG. 7 according to another embodiment of the present invention.
Figure 13:
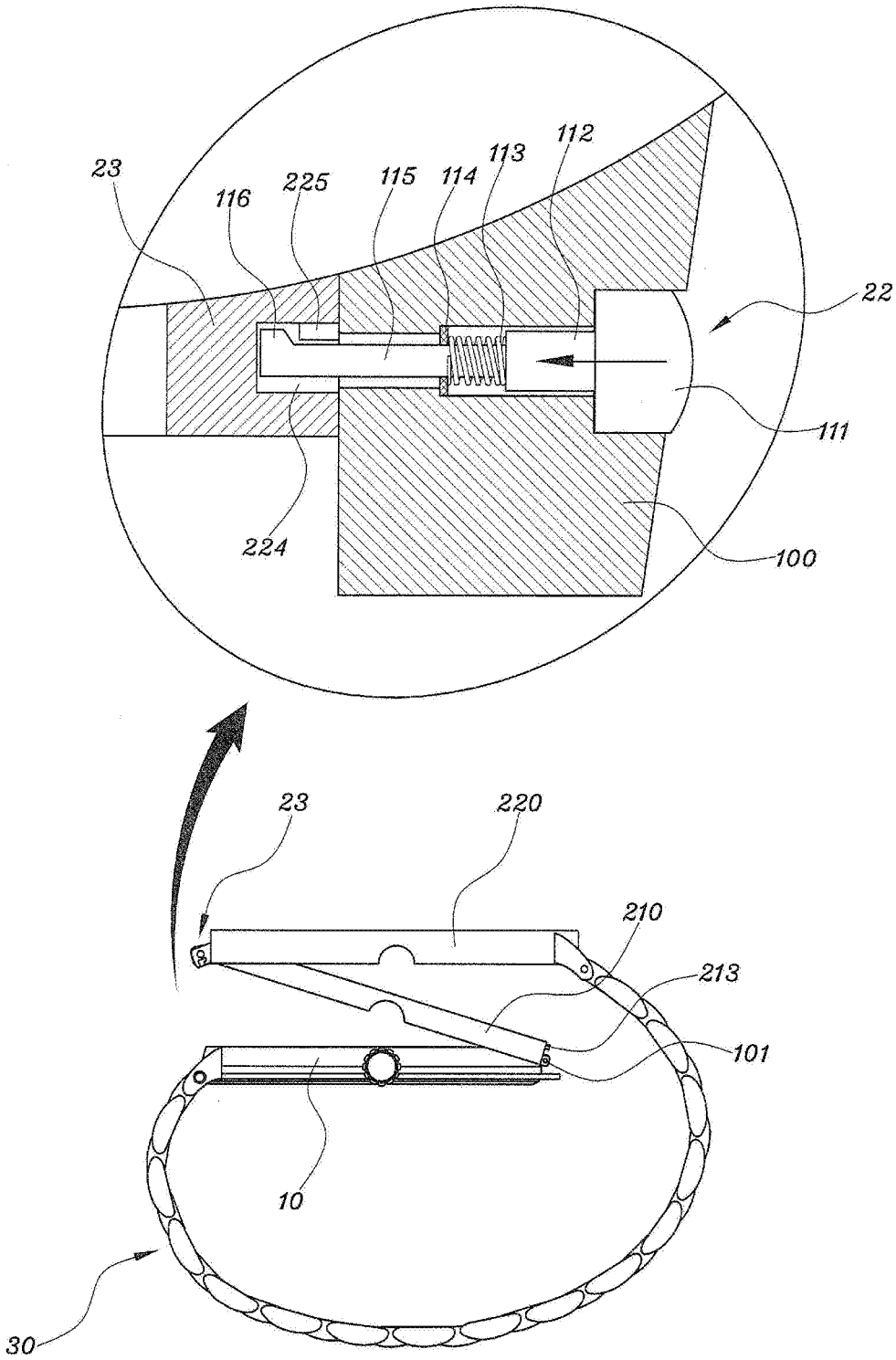
FIG. 13 is an enlarged sectional view illustrating the state in which the first fastening unit is released from the second fastening unit collaterally serving as the fourth hinge by pressing, in the device for fastening and unfastening the watch of FIG. 7 according to another embodiment of the present invention.
Figure 14:
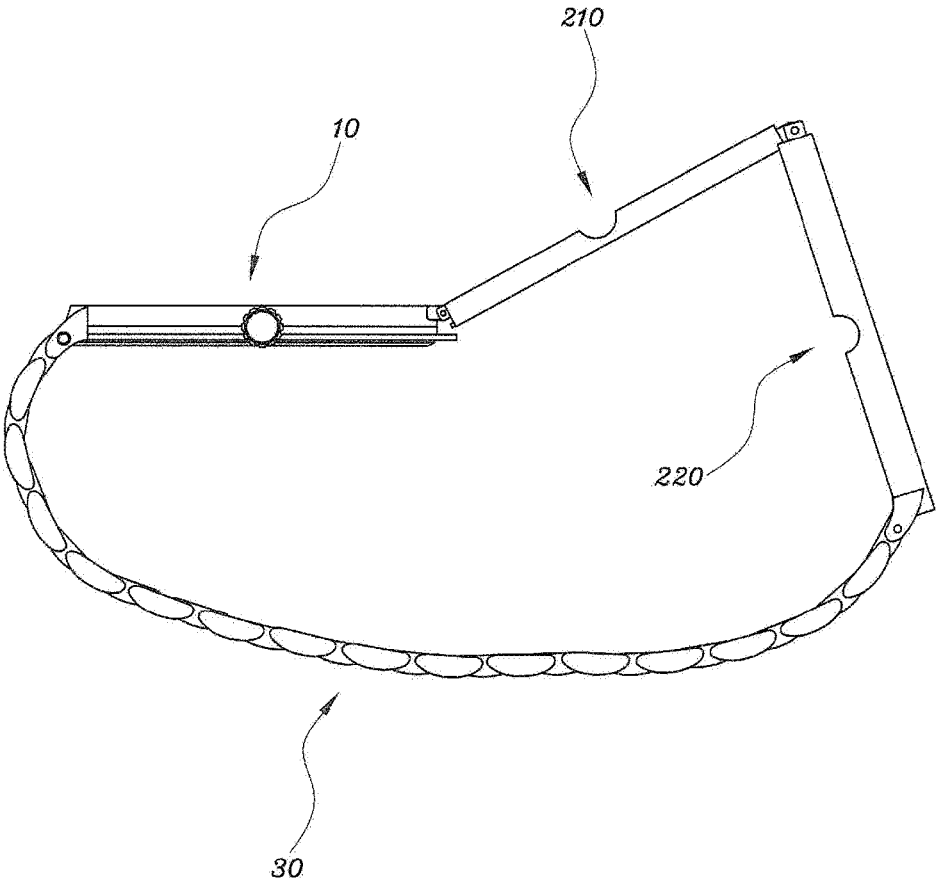
FIG. 14 is a front view illustrating a state in which a connecting bezel and a fastening bezel are completely released from a main body of the device for fastening and unfastening the watch of FIG. 7 according to another embodiment of the present invention.

FIG. 1 illustrates a watch equipped with a device for fastening and unfastening a watch according to the present invention in a plan view and a perspective view, FIG. 2 is a perspective view illustrating a state in which the device for fastening and unfastening the watch according to the present invention is released, FIG. 3 is an exploded perspective view illustrating essential parts of the device for fastening and unfastening the watch according to the present invention, FIG. 4 is a sectional view illustrating a coupled state of the essential parts of the device for fastening and unfastening the watch according to the present invention, FIG. 5 is a front view illustrating a releasing process in the device for fastening and unfastening the watch according to the present invention, FIG. 6 is a front view illustrating a completely released state in the device for fastening and unfastening the watch according to the present invention, FIG. 7 illustrates a watch equipped with a device for fastening and unfastening a watch according to another embodiment of the present invention in a plan view and a perspective view, FIG. 8 is a perspective view illustrating a state in which a connecting bezel and a fastening bezel are released from a main body of the watch equipped with the device for fastening and unfastening the watch of FIG. 7 according to another embodiment of the present invention, FIG. 9 is an exploded perspective view illustrating a first fastening unit of the device for fastening and unfastening the watch of FIG. 7 according to another embodiment of the present invention, FIG. 10 is a perspective view illustrating a state in which the first fastening unit is fastened to a second fastening unit collaterally serving as a fourth hinge, in the device for fastening and unfastening the watch of FIG. 7 according to another embodiment of the present invention, FIG. 11 is a perspective view illustrating a state in which the first fastening unit is released from the second fastening unit collaterally serving as the fourth hinge by pressing, in the device for fastening and unfastening the watch of FIG. 7 according to another embodiment of the present invention, FIG. 12 is an enlarged sectional view illustrating the state in which the first fastening unit is fastened to a second fastening unit collaterally serving as the fourth hinge, in the device for fastening and unfastening the watch of FIG. 7 according to another embodiment of the present invention, FIG. 13 is an enlarged sectional view illustrating the state in which the first fastening unit is released from the second fastening unit collaterally serving as the fourth hinge by pressing, in the device for fastening and unfastening the watch of FIG. 7 according to another embodiment of the present invention, and FIG. 14 is a front view illustrating a state in which a connecting bezel and a fastening bezel are completely released from a main body of the device for fastening and unfastening the watch of FIG. 7 according to another embodiment of the present invention.

The configuration of the present invention will be described below.

As illustrated in FIG. 1, a watch according to the present invention is very similar to a general wrist watch, that is, it includes a watch main body 10 having a component for driving the watch and a time display, a bezel unit 20 provided around the watch main body 10 to constitute a cover of the watch, and a watch band 30 fastening the watch to a wrist.

According to the key features of the invention, the watch band 30 is integrated with the watch, and the bezel unit 20 is provided with a fastening unit 21.

As illustrated in FIGS. 2 to 4, the fastening unit 21 provided on the bezel unit 20 includes a watch main body-covering bezel 200, a rotatable connecting bezel 210, a fastening bezel 220, and the watch band 30. The watch main body-covering bezel 200 is configured to cover the watch main body 10, and has a first protrusion 201 on a center of a first side of the bezel and a second protrusion 202 on a center of a second side of the bezel.

The rotatable connecting bezel 210 has on a lower end of a center of a first side thereof a first groove 212 in a state where the rotatable connecting bezel is rotatably connected to both ends of the second side of the watch main body-covering bezel 200 by a first hinge 211.

The fastening bezel 220 is rotatably connected to both ends of the first side of the rotatable connecting bezel 210 by a second hinge 221, with a second groove 222 being formed on an inner surface of a center of a second side of the fastening bezel.

The watch band 30 is integrally coupled from an outer surface of the second side of the fastening bezel 220 to an outer surface of the first side of the watch main body-covering bezel 200.

An operation of the present invention will be described below.

First, FIG. 1 illustrates a state in which the device is fastened, and FIGS. 5 and 6 illustrate a state in which the device is not fastened.

FIG. 3 is an exploded view to illustrate the present invention. As illustrated in FIG. 5, first, the rotatable connecting bezel 210 is coupled to the first side of the watch main body-covering bezel 200 to be rotatable about the first hinge 211 formed on the first side of the rotatable connecting bezel 210.

Next, the second side of the rotatable connecting bezel 210 is coupled to the fastening bezel 220 to be rotatable about the second hinge 221 formed on the fastening bezel 220.

Of course, although not shown in FIG. 3, the band 30 is fixedly coupled to a side opposite to the second hinge 221 of the fastening bezel 220 and to a side opposite to the first hinge 211 of the watch main body-covering bezel 200, as illustrated in FIG. 5, so that the band 30 has an integrated structure and requires no fastening means.

In such a state, if the fastening unit 21 is fastened as illustrated in FIG. 4, the wrist watch of the present invention is fastened to a user's wrist. To be more specific, as illustrated in FIG. 4, when the first protrusion 201 of the watch main body-covering bezel 200 engages with the first groove 212 of the rotatable connecting bezel 210 and then the second protrusion 202 of the watch main body-covering bezel 200 engages with the second groove 222 of the fastening bezel 220, the fastening operation of the fastening unit 21 of the present invention is completed, so that the watch is fastened to a user's wrist.

In contrast, when a user desires to release the watch from his or her wrist, as illustrated in FIG. 6, the second protrusion 202 of the watch main body-covering bezel 200 is separated from the second groove 222 of the fastening bezel 220 by rotating it about the second hinge 221 as illustrated in FIG. 5. Subsequently, the first protrusion 201 of the watch main body-covering bezel 200 is separated from the first groove 212 of the rotatable connecting bezel 210 by upwardly rotating the rotatable connecting bezel 210 about the first hinge 211. Then, as illustrated in FIG. 6, the fastening unit 21 is unfastened, thus allowing the watch to be released from the user's wrist.

Meanwhile, the detailed configuration and operation of another embodiment of the present invention will be described with reference to FIGS. 7 to 14.

The configuration of another embodiment of the present invention will be described below.

Reference numeral 10 denotes a watch main body. As illustrated in FIGS. 7 and 8, the watch main body 10 has a component for driving the watch and a time display. The watch main body has on a first side thereof a plurality of extension pieces 100, and on a second side thereof a third hinge 101. A first side of a watch band 30 is coupled to the extension piece 100, with a through hole 102 penetrated through a leading end of the extension piece. A first fastening unit 22 is fitted into the through hole 102.

Reference numeral 210 denotes a rotatable connecting bezel. As illustrated in FIGS. 8 and 13, the rotatable connecting bezel 210 is rotatably coupled at a first side thereof with the watch main body 10 by the third hinge 101, with a fastening projection 213 being provided on an outer circumference of an upper portion of the third hinge 101. The rotatable connecting bezel has on a second side thereof a second fastening unit 23 that collaterally serves as a fourth hinge.

Reference numeral 220 denotes a fastening bezel. As illustrated in FIG. 8, the fastening bezel 220 is rotatable at a first side thereof by the second fastening unit 23 that collaterally serves as the fourth hinge of the rotatable connecting bezel 210, and is coupled at a second side thereof with the second side of the watch band 30, with a fastening hole 223 formed in an inner circumference of the fastening bezel. The watch band 30 is integrally coupled from the extension piece 100 of the watch main body 10 to the second side of the fastening bezel 220.

Meanwhile, as illustrated in FIGS. 7 and 8, the first fastening unit 22 is coupled to the through hole 102, and includes a button 111 that is provided on a first side of the first fastening unit to protrude out from the through hole 102, a guide bar 112 that is integrally provided on the button 111, a fastening bar 115 that is fastened to an end of the guide bar 112 in a screw-type fastening method, a spring 113 that is coupled to the fastening bar 115, a spring removal prevention plate 114 that is provided on an end of the spring 113, and a fastening hook 116 that is integrally formed on an end of the fastening bar 115.

As illustrated in FIG. 8 and FIGS. 10 to 13, the second fastening unit 23 collaterally serving as the fourth hinge is provided on a side of the rotatable connecting bezel 210 and the fastening bezel 220, and has a groove 224 of a predetermined length to allow the fastening hook 116 to be movable. Further, a locking step 225 is provided on a leading end of the groove 224 to fasten the fastening hook 116 thereto.

Hereinafter, the operation of another embodiment of the present invention will be described with reference to the accompanying drawings.

First, if the button 111 of the first fastening unit 22 is not pressed as illustrated in FIGS. 7, 10, and 12, in the state where the watch according to another embodiment of the present invention is fastened to a user's wrist, the fastening hook 116 is fastened to the locking step 225, so that the connecting bezel 210 and the fastening bezel 220 are fixedly fastened to the watch main body 10.

That is, after a user has put on the watch on his or her wrist in the state of FIG. 8, the rotatable connecting bezel 210 rotates downwards about the third hinge 101, and simultaneously the fastening projection 213 provided on the outer circumference of the first side of the rotatable connecting bezel 210 is fitted into the fastening hole 223 formed in the inner circumference of the second side of the fastening bezel 220, and simultaneously the button 111 of the first fastening unit 22 is pressed and maintained as shown in FIG. 13. Thereafter, if the second fastening unit 23 collaterally serving as the fourth hinge is inserted between the extension pieces 100, the first fastening unit 22 is inserted into the groove 224 of the second fastening unit 23 collaterally serving as the fourth hinge. Simultaneously, if the pressing of the button 111 is released, as illustrated in FIGS. 10 and 12, the fastening hook 116 is fastened to the locking step 225, so that the watch is secured on a user's wrist.

Meanwhile, in order to take off the watch from the user's wrist, as illustrated in FIGS. 11 and 13, the button 111 is pressed. At this time, the fastening hook 116 is released from the locking step 225, so that the first fastening unit 22 is freely released from the groove 224 of the second fastening unit 23 collaterally serving as the fourth hinge and thereby the rotatable connecting bezel 210 and the fastening bezel 220 are released from each other in a one-touch manner as illustrated in FIG. 13. Next, if the fastening projection 213 provided on the outer circumference of the first side of the rotatable connecting bezel 210 is released from the fastening hole 223 formed on the inner circumference of the second side of the fastening bezel 220, as illustrated in FIG. 14, the user may take off the watch from his or her wrist.

The present invention, adopting a structure that is completely different from the related art in which a fastening unit is provided on a band, has a fastening means on a watch main body and a bezel rather than on a band, thus offering good appearance and completely preventing blood circulation from being obstructed and preventing the wrist from being injured unlike the related art in which the fastening means is provided on the watch band thereby causing the wrist to be injured or placing undesirable pressure on the wearer's wrist, and allowing the watch to be smoothly fastened or unfastened easily and conveniently in a one-touch manner without damaging the bezel. In this way, the watch band performs only a wrist banding function that is an original function of the watch band, thus lengthening a service life of the watch band.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for fastening and unfastening a watch comprising a watch main body having a component for driving the watch and a time display, a bezel unit provided around the watch main body to constitute a cover of the watch, and a watch band fastening the watch to a wearer's wrist, the watch band being integrated with the watch and the bezel unit being provided with a fastening unit, wherein the fastening unit provided on the bezel unit comprises:

a watch main body-covering bezel configured to cover the watch main body, and having a first protrusion on a center of a first side of the bezel and a second protrusion on a center of a second side of the bezel;

a rotatable connecting bezel having on a lower end of a center of a first side thereof a first groove in a state where the rotatable connecting bezel is rotatably connected to both ends of the second side of the watch main body-covering bezel by a first hinge;

a fastening bezel rotatably connected to both ends of the first side of the rotatable connecting bezel by a second hinge, with a second groove being formed on an inner surface of a center of a second side of the fastening bezel; and the watch band integrally coupled from an outer surface of the second side of the fastening bezel to an outer surface of the first side of the watch main body-covering bezel.

2. A device for fastening and unfastening a watch, the device comprising:

a watch main body having a component for driving the watch and a time display, a plurality of extension pieces formed on a first side thereof and a third hinge formed on a second side thereof, wherein a first side of a watch band is coupled to the extension piece, with a through hole penetrated through a leading end of the extension piece, and a first fastening unit is fitted into the through hole;

a rotatable connecting bezel rotatably coupled at a first side thereof with the watch main body by the third hinge, and having on a second side thereof a second fastening unit that collaterally serves as a fourth hinge, with a fastening projection being provided on an outer circumference of an upper portion of the third hinge; and a fastening bezel rotated at a first side thereof by the second fastening unit that collaterally serves as the fourth hinge of the rotatable connecting bezel, and coupled at a second side thereof with the second side of the watch band, with a fastening hole formed in an inner circumference of the fastening bezel, so that the watch band is integrally coupled from the extension piece of the watch main body to the second side of the fastening bezel.

3. The device of claim 2, wherein the first fastening unit is coupled to the through hole, and comprises:

a button provided on a first side of the first fastening unit to protrude out from the through hole;

a guide bar integrally provided on the button;

a fastening bar fastened to an end of the guide bar in a screw-type fastening method;

a spring coupled to the fastening bar;

a spring removal prevention plate provided on an end of the spring; and a fastening hook integrally formed on an end of the fastening bar, and the second fastening unit collaterally serving as the fourth hinge is provided on a side of the rotatable connecting bezel and the fastening bezel, and has a groove of a predetermined length to allow the fastening hook to be movable, a locking step being provided on a leading end of the groove to fasten the fastening hook thereto.

* * * * *